US005821702A

United States Patent [19]

Vegter

[11] Patent Number: 5,821,702

[45] Date of Patent: Oct. 13, 1998

[54] DISCHARGE LAMP CONTROL CIRCUIT USING A LUMINOUS FLUX TABLE

[75] Inventor: Klaas Vegter, Eindhoven, Netherlands

[73] Assignee: U.S. Philips Corporation, New York, N.Y.

[21] Appl. No.: 905,652

[22] Filed: Aug. 4, 1997

Related U.S. Application Data

[63] Continuation of Ser. No. 523,063, Sep. 1, 1995, abandoned.

[30] Foreign Application Priority Data

Sep. 6, 1994 [EP] European Pat. Off. ..... 94202542

[51] Int. Cl.[6] ..... H05B 37/02

[52] U.S. Cl. ..... 315/307; 315/DIG. 4; 315/224

[58] Field of Search ..... 315/307, 308, 315/DIG. 4, 209 R, 219, 224, 292, 293

[56] References Cited

U.S. PATENT DOCUMENTS 5,039,921 8/1991 Kakitani ..... 315/308

FOREIGN PATENT DOCUMENTS 0391383 10/1990 European Pat. Off. .

*Primary Examiner*—Benny T. Lee
*Assistant Examiner*—Michael Shingleton
*Attorney, Agent, or Firm*—Edward Blocker

[57] ABSTRACT

The invention relates to a circuit arrangement for operating a lamp (La), provided with ballast means (B) for generating a lamp current from a supply voltage, a memory (M) in which a relation between a number of temperature-dependent lamp parameters has been laid down, means (II, IV, V*a*, V*b*) coupled to the memory for changing lamp operation in dependence on the temperature.

According to the invention, the temperature-dependent parameters are the voltage across the lamp, the current through the lamp, and the luminous flux of the lamp. The actual luminous flux of the lamp is determined by means of the memory through a measurement of the voltage across the lamp and the current through the lamp. The luminous flux of the lamp can be controlled to a substantially temperature-independent and substantially constant level in that this actual value of the luminous flux is used as a signal in a control loop, with the exclusive use of electrical parameters.

5 Claims, 1 Drawing Sheet

DISCHARGE LAMP CONTROL CIRCUIT USING A LUMINOUS FLUX TABLE

Figure 1:
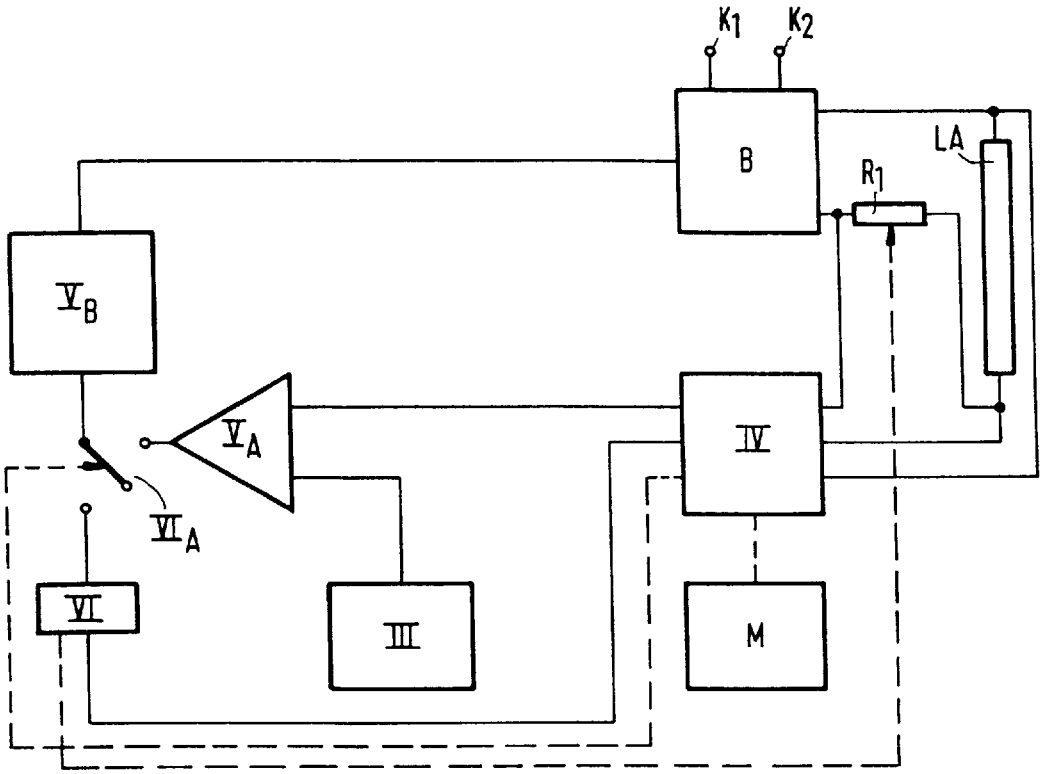

This is a continuation of application Ser. No. 08/523,063, filed Sep. 1, 1995, now abandoned.

The invention relates to a circuit arrangement for operating a lamp, provided with ballast means for generating a lamp current from a supply voltage, a memory in which a relation between a number of temperature-dependent lamp parameters has been laid down, means coupled to the memory for changing lamp operation in dependence on the temperature.

Such a circuit arrangement is known from European Patent 391383. The temperature dependence of parameters relating to preheating and igniting of a discharge lamp have been laid down in the memory of the known circuit arrangement. A temperature sensor measures the temperature and, for example, the amplitude of the preheating current and the amplitude of the ignition voltage are adjusted in dependence on the measured temperature value. Preheating of the lamp electrodes and lamp ignition are thus adapted to the ambient temperature. Not only the required preheating current and the required ignition voltage, but also the lumen output of the lamp depends strongly on the temperature. It is possible to accommodate this temperature dependence by measuring the temperature with a temperature sensor and adjusting the power consumed by the lamp to a value which leads to the desired luminous flux value at the measured temperature, in a manner corresponding to the adaptation of the ignition voltage and the preheating current to the temperature as described in European Patent 391383. The use of a temperature sensor, however, renders the circuit arrangement comparatively expensive and complicated.

The invention has for its object to provide a circuit arrangement which maintains the luminous flux of a lamp operated by means of the circuit arrangement substantially independently of the temperature over a substantial temperature range, while the circuit arrangement is at the same time comparatively simple and inexpensive.

According to the invention, a circuit arrangement as described in the opening paragraph is for this purpose characterized in that the parameters comprise a current through the lamp, a voltage across the lamp, and a luminous flux of the lamp, and the means for changing lamp operation in dependence on the temperature comprise means I for generating a signal S1 which is a measure for the voltage across the lamp, means II for generating a signal S2 which is a measure for the current through the lamp, means III for generating a signal S3 which is a measure for a desired value of the luminous flux of the lamp, means IV for determining the luminous flux of the lamp by means of the memory and signals S1 and S2, and means V for adjusting lamp operation in dependence on the luminous flux of the lamp and on signal S3.

During lamp operation, the luminous flux of the lamp is derived from the voltage across the lamp and the current through the lamp by means I, II and IV and by the memory. Since this method of determining the luminous flux does not use, for example, a light sensor or temperature sensor, the luminous flux is determined by comparatively simple means. The means V adjust lamp operation in dependence on the determined luminous flux and the signal S3. It was found that the luminous flux of a lamp operated by means of the circuit arrangement according to the invention is substantially independent of the temperature over a comparatively wide temperature range. It was also found that a discharge lamp operated by means of the circuit arrangement according to the invention has a good run-up behaviour. This is the case more particularly when the discharge lamp is provided with an amalgam acting as a reservoir for a substance which is present in the plasma during stationary lamp operation. The term "run-up behaviour" is to be understood here as the increase in the luminous flux during a time interval which starts immediately after lamp ignition and ends when the lamp enters stationary operation. Immediately after the ignition of, for example, a low-pressure mercury discharge lamp (called lamp hereinafter) provided with an amalgam as a mercury reservoir in the discharge vessel, the temperature of the amalgam is comparatively low. As a result, comparatively little mercury is present in the plasma, so that the luminous flux of the lamp is comparatively low. After lamp ignition the lamp temperature rises owing to the discharge, so that also the amalgam temperature rises and the quantity of mercury present in the plasma increases as a result. In proportion as the mercury quantity in the plasma increases, the luminous flux of the lamp also rises. This luminous flux continues to rise until the temperature of the lamp does not rise any further. It is desirable in many applications to keep the time interval during which the luminous flux of the lamp rises from the value immediately after ignition to the stationary lamp operation value as short as possible. If such a low-pressure mercury discharge lamp is operated by means of a circuit arrangement according to the invention, the means IV determine the luminous flux immediately after lamp ignition on the basis of the current through the lamp, the voltage across the lamp, and the memory. Since this luminous flux is smaller than the desired value, the means V apply a change to the lamp operation whereby the luminous flux rises. The effect of this is that the luminous flux of a lamp operated by means of a circuit arrangement according to the invention is comparatively high immediately after ignition. The luminous flux also reaches the substantially constant value accompanying stationary lamp operation after a comparatively short time interval.

An advantageous embodiment of a circuit arrangement according to the invention is characterized in that the relation between said number of temperature-dependent parameters of the discharge lamp is stored in the memory in the form of a table. It was found that the means IV can be constructed in a comparatively simple manner in this case.

A further advantageous embodiment of a circuit arrangement according to the invention is characterized in that the circuit arrangement is in addition provided with means for temporarily changing the value of the current through the lamp and for deriving the luminous flux of the discharge lamp from changes, resulting therefrom, in the value(s) of one or several temperature-dependent lamp parameters and from the memory. If there is no unequivocal relation between the luminous flux (and the temperature) of the lamp on the one hand and the voltage across the lamp and the current through the lamp on the other hand, these means may be used for determining the luminous flux (and the temperature). In the case of low-pressure mercury discharge lamps, for example, it is often found that each combination of a current value through the lamp and a voltage value across the lamp corresponds to two lamp plasma temperatures, and thus to two luminous flux values, over a range of the current through the lamp and over a further range of the voltage across the lamp. It is possible in such a situation to determine the luminous flux (the temperature) of the lamp in that the power consumed by the lamp or the current flowing through the lamp is changed during a time interval. This achieves a reduction or increase in the temperature of the lamp. It can then be determined which of the two possible luminous flux values was the actual value by subsequently determining, after the time interval, whether the value of one or several temperature-dependent parameters has risen or dropped.

Figure 2:
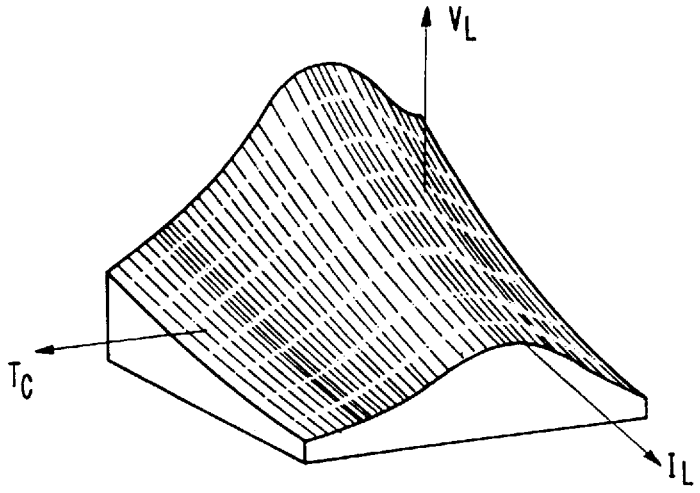

An embodiment of the invention will be explained in more detail with reference to a drawing, in which FIG. 1 is a diagram of an embodiment of a circuit arrangement according to the invention; and FIG. 2 shows the temperature of the coldest spot in a compact low-pressure mercury discharge lamp as a function of the voltage across the low-pressure mercury discharge lamp and the current through the low-pressure mercury discharge lamp.

In FIG. 1, B are ballast means for generating a lamp current from a supply voltage. Ballast means B are provided with input terminals K1 and K2 for connection to a supply voltage source. A series arrangement of a lamp La and an ohmic resistor R1 is connected to output terminals of the ballast means B. Circuit portion IV forms means for determining the luminous flux of the lamp. A first end of the lamp, a common junction point of the lamp and the resistor, and a further end of the resistor are coupled to three respective inputs of circuit portion IV. The voltage difference between the first two inputs forms a signal S1 which is a measure for the voltage across the lamp during lamp operation. The couplings between the lamp and the first two inputs form means I for generating the signal S1. The voltage difference between the second and the third input forms a signal S2 which is a measure for the current through the lamp during lamp operation. The couplings between the resistor R1 and the second and the third input of circuit portion IV form means II for generating signal S2. Circuit portion IV is coupled to memory M. Memory M contains a relation between the current through the lamp, the voltage across the lamp, and the luminous flux in the form of a table. Circuit portion VI and switching element VI*a* together form means for temporarily changing the current through the lamp. Circuit portion VI*a* forms a signal generator for generating a signal for increasing the lamp current most recently measured by, for example, 10% via circuit portion V*b*. A first output of circuit portion IV is connected to a first input of comparator V*a*. Comparator V*a* forms means for generating an analog signal which is a measure for the difference between the actual luminous flux value determined via the memory and the desired luminous flux. A second output of circuit portion IV is connected to a first input of circuit portion VI. A further input of circuit portion VI is coupled to the resistor R1. This coupling is indicated with a broken line in the Figure. An output of circuit portion VI is coupled to a first main electrode of switching element VI*a*. A third output of circuit portion IV is coupled to a control electrode of switching element VI*a*. This coupling is indicated with a broken line in FIG. 1. Circuit portion III forms means for generating a signal S3 which is a measure for a desired luminous flux value. Comparator Va and circuit portion V*b* together form means V for adjusting lamp operation in dependence on the luminous flux and on the signal S3. A second input of comparator V*a* is connected to an output of circuit portion III. An output of comparator V*a* is connected to a second main electrode of switching element VI*a*. A third main electrode of switching element VI*a* is connected to an input of circuit portion V*b*. An output of circuit portion V*b* is connected to an input of ballast means B.

The operation of the circuit arrangement shown in FIG. 1 is as follows.

When the input terminals K1 and K2 are connected to a supply voltage source, the ballast means B generate a current through the lamp La from a supply voltage delivered by the supply voltage source. Signals S1 and S2 are present between the inputs of circuit portion IV via the couplings which in this embodiment form the means I and II. The circuit portion IV determines the luminous flux of the lamp from the signals S1 and S2 and the table present in memory M. If the values determined for the current through the lamp and the voltage across the lamp are not identical to the values tabled in memory M, the luminous flux value is obtained through linear interpolation. A signal is present at the first output of circuit IV which is a measure for the actual luminous flux in those cases in which the relation between the voltage across the lamp and the current through the lamp on the one hand and the luminous flux of the lamp on the other hand is unequivocal. This signal is also present at the first input of comparator V*a*. Signal S3, which is a measure for a desired luminous flux value of the lamp, is present at the second input of comparator V*a*. A signal is also present at the third output of circuit portion IV under the influence of which this third output keeps switching element VI*a* in a first state via the control electrode of this switching element, in which state the second main electrode is conductively connected to the third main electrode. In this first state, the signal at the output of comparator V*a*, which is a measure for the difference between the actual luminous flux value determined via the memory and the desired luminous flux, is also present at the input of circuit portion V*b*. Circuit portion V*b* adjusts the lamp operation in dependence on the signal present at the output of comparator V*a*. Of the luminous flux as determined is lower than the desired luminous flux, the lamp current is increased by circuit portion V*b*. When the ballast means B comprise a DC-AC converter to which the lamp is connected, the current through the lamp may be adjusted, for example, in that the duty cycle and/or the frequency of one or several switching elements of the DC-AC converter is adjusted.

Depending on the lamp type, the relation between the voltage across the lamp, and the current through the lamp on the one hand and the luminous flux of the lamp on the other hand is often not unequivocal over a certain range of the current through the lamp and the voltage across the lamp. In other words, two possible values for the luminous flux are found in the table of memory M for the relevant values of the voltage across the lamp and of the current through the lamp. In that case, the values determined for the voltage across the lamp and the current through the lamp are temporarily stored in a memory which forms part of the circuit portion IV. The circuit portion IV also generates a signal at the third output of the circuit portion IV under the influence of which the switching element VI*a* is brought into a second state during a certain time interval in which the first main electrode and the third main electrode are conductively interconnected. As a result of this, the signal generated by the circuit portion VI is also applied to the input of circuit portion V*b*. So a signal which is a measure for the current through the lamp most recently measured is also present at the second output of circuit portion IV and accordingly also at the first input of circuit portion VI. The coupling between the resistor R1 and the further input of circuit portion VI means that the signal S2 is applied to this further input.

The signal at the output of circuit portion VI controls the current through the lamp to a value which is approximately 10% higher than the most recently measured value, via circuit portion V*b*. After the time interval has elapsed, the switching element is brought into the first state again by means of the signal at the second output of circuit portion IV. Since the current through the lamp had a higher value during the time interval, the temperature of the lamp has increased. The means IV determine whether this has caused an increase or a decrease in the voltage across the lamp in that the voltage value across the lamp after the time interval is compared with the value before the time interval stored in the memory. If the lamp is a compact low-pressure mercury discharge lamp and the voltage across the lamp has risen, this means that the lamp temperature had the lower of the two values corresponding to the voltage across the lamp and current through the lamp determined before the time interval. If the voltage across the lamp has dropped, however, this means that the lamp temperature had the higher of the two values corresponding to the voltage across the lamp and current through the lamp determined before the time interval. The two temperature values correspond to the different luminous flux values of the lamp laid down in the table in memory M. It is accordingly also determined which of the two possible luminous flux values is the actual value in that the lamp temperature is determined in the manner described above. The circuit portion IV generates at its first output a signal which is a measure for the determined luminous flux, and since the switching element VI*a* is in its first state again, the luminous flux control proceeds further as described above.

FIG. 2 shows, plotted on three orthogonal axes for a low-pressure mercury discharge lamp, the current through the lamp ($I_L$), the voltage across the lamp ($V_L$) and the temperature of the coldest spot of the lamp ($T_C$), in arbitrary units.

FIG. 2 shows that most of the possible values for the voltage across the lamp and the current through the lamp correspond to two values for the coldest spot temperature in the lamp in the case of the compact low-pressure mercury discharge lamp for which the pictured data were measured. These different temperature values of the coldest spot of the lamp correspond to different luminous flux values, so that also the relation between lamp current and lamp voltage on the one hand and the luminous flux of the lamp on the other hand is not unequivocal. The problems involved in this ambiguity relating to the control of the luminous flux of the lamp by means of a circuit arrangement according to the invention can be counteracted in the manner described above.

I claim:

1. A circuit arrangement for operating a lamp having a known assumed correspondence between various possible values of luminous flux produced by the lamp and the combinations of lamp voltage and lamp current that produce the various possible values of luminous flux comprising:

a ballast for applying an actual lamp voltage across the lamp and causing an actual lamp current to flow through the lamp, the ballast being controllable;

a memory in which various possible values of luminous flux produced by the lamp are stored in correspondence with the combinations of lamp voltage and lamp current that produce the various possible values of luminous flux;

means I for generating a signal S1 which is a measure of the actual voltage applied across the lamp;

means II for generating a signal S2 which is a measure of the actual current flowing through the lamp;

means III for generating a signal S3 which is a measure of a desired value of luminous flux of the lamp;

means IV for determining the actual luminous flux of the lamp from the memory by retrieving a stored value of luminous flux corresponding to signals S1 and S2; and means V for controlling the ballast in dependence on the luminous flux of the lamp determined by means IV and on signal S3.

2. A circuit arrangement as claimed in claim 1 wherein the memory stores various possible values of luminous flux produced by the lamp in correspondence with the combinations of lamp voltage and lamp current that produce the various possible values of luminous flux in the form of a table.

3. A circuit arrangement as claimed in claim 1 wherein at least one combination of lamp voltage and lamp current stored in the memory corresponds to more than one stored value of possible luminous flux and means IV includes means for temporarily changing the value of current flowing through the lamp in the event S1 and S2 correspond to one of said at least one combination and for detecting a change in voltage across the lamp resulting therefrom as a basis for determining which of the more than one stored value of possible luminous flux corresponds to the actual luminous flux.

4. A circuit arrangement as claimed in claim 1 wherein means V includes a comparator for determining a difference between signal S3 and the luminous flux of the lamp determined by means IV and wherein the ballast is controlled so as to reduce this difference.

5. A circuit arrangement for operating a lamp having a known assumed relationship between the luminous flux output from the lamp and the lamp voltage and lamp current, comprising:

a ballast for applying an actual lamp voltage across the lamp and causing an actual lamp current to flow through the lamp, the ballast being controllable;

a memory in which a relationship is stored between output luminous flux of the lamp and corresponding lamp voltage and lamp current;

means I for generating a signal S1 which is a measure of the actual voltage applied across the lamp;

means II for generating a signal S2 which is a measure of the actual current flowing through the lamp;

means III for generating a signal S3 which is a measure of a desired value of luminous flux of the lamp;

means IV for determining the actual luminous flux of the lamp from the relationship stored in the memory and the signals S1 and S2; and means V for controlling the ballast in dependence on the luminous flux of the lamp determined by means IV and on signal S3.

* * * * *